US006725790B2

(12) United States Patent
Sadasue

(10) Patent No.: US 6,725,790 B2
(45) Date of Patent: Apr. 27, 2004

(54) CLOTH CUTTING KNIFE DRIVING DEVICE

(75) Inventor: Kazuya Sadasue, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/151,232

(22) Filed: May 20, 2002

(65) Prior Publication Data

US 2002/0195035 A1 Dec. 26, 2002

(30) Foreign Application Priority Data

May 21, 2001 (JP) ..... 2001-150559

(51) Int. Cl.[7] ..... D05B 37/06
(52) U.S. Cl. ..... 112/125; 112/129
(58) Field of Search ..... 112/129, 122, 112/125, 122.1, 128, 157, 220; 83/571, 936, 938, 939, 918, 901, 910

(56) References Cited

U.S. PATENT DOCUMENTS 5,289,789 A * 3/1994 Sakuma ..... 112/122
5,427,041 A * 6/1995 Satoma ..... 112/125
5,813,356 A * 9/1998 Nolle ..... 112/122
6,101,960 A * 8/2000 Ebata et al. ..... 112/122
6,253,694 B1 * 7/2001 Mitsuji ..... 112/122

* cited by examiner

*Primary Examiner*—Ismael Izaguirre
(74) *Attorney, Agent, or Firm*—Morgan & Finnegan LLP

(57) ABSTRACT

A cloth cutting knife driving device is capable of being released, through an interlocking connection between an upper knife rocking arm and a sewing machine main shaft. The device includes a drive shaft, which is able to swing rotatably, by interlocking with a main shaft, a rocking arm rotatably supported on the drive shaft at one end providing a rocking motion, and a cloth cutting knife supported at the one end of the rocking arm that is rigidly held in a cloth cutting position or an inactive position, which is vertically displaced through the motion of the arm. The device has a coupled and released state between the drive shaft and rocking arm, which are brought about by an engaging part on the drive shaft and a movable member, movable relative to the rocking arm in a direction perpendicular to an axis of the drive shaft.

11 Claims, 7 Drawing Sheets

CLOTH CUTTING KNIFE DRIVING DEVICE

BACKGROUND OF THE INVENTION

1. Field of Invention

The present invention relates to a cloth cutting knife driving device for a sewing machine.

2. Description of the Related Art

Conventional sewing machines are capable of forming over-edge stitches and other stitches such as covering stitches. In such sewing machines, when the over edge stitches are formed on a work cloth, the cloth edge is cut during stitching by a slide movement of an upper knife and a lower knife, the upper knife being supported on an upper knife rocking arm movable up and down, and the lower knife being fixed on a machine frame. When conventional sewing machines perform the covering stitches without cloth cutting, the upper knife remains inactive. To this end, the upper knife rocking arm rotatably supports the upper knife, so that the upper knife can be in an active position, acting on the lower knife or an inactive position, rotated apart from the lower knife, so as to not cut cloth.

However, since the upper knife rocking arm interlocks with a sewing machine main shaft, the rocking arm swings during machine operation even when the upper knife is in the inactive position. In this state the rocking arm of the conventional sewing machine is not only hazardous but also obstructive. Specifically, the sewing machine obstructs a user during operation, thus cutting down the usable work area.

In order for the upper knife rocking arm to stop swinging during operation without cloth cutting, some upper knife release devices have been developed, for example as disclosed in U.S. Pat. No. 5,427,041. In such release devices, the rocking arm stops swinging because its connection to the main shaft is released.

In one embodiment of U.S. Pat. No. 5,427,041, a greater number of elements are used for releasing the connection between the rocking arm and the main shaft. This aspect contributes to increased play at the upper knife portion and higher cost of the device.

In prior art embodiment illustrated in FIG. 8, the upper knife releasing device has an upper knife driving arm 122 for converting the rotating motion of a main shaft 118 into a rocking motion, an upper knife drive(rocking) shaft 124 rotatably supported on a machine frame to be swung by the driving arm 122. The upper knife releasing device also includes an upper knife rocking arm 116 which is rotatably supported on the drive shaft 124 at one end, an upper knife 138 at the other end, and an upper knife driving plate 126 which is rotatably supported on the drive shaft 124 at one end and has an end hole 126*b* at the other end. The one end of the driving plate 126 is fixed to the driving arm 122. In this structure the rotation of the main shaft 118 causes the driving arm 122 and the driving plate 126 to rotate about the drive shaft 124, which causes the other end of the driving plate 126 to swing up and down.

At the other end of the rocking arm 116, a coupling pin 148 is provided, being supported by a coupling pin tightening screw 162, so as to fit into the end hole 126*b* on the driving plate 126. With the above setup, the up and down swinging of the other end of the driving plate 126 causes the upper-knife rocking arm 116 to rotate about the drive shaft 124 and drive the upper knife 138 up and down. Thus, the drive shaft 124 is coupled to the rocking arm 116. When the knife 138 is to be released, the coupling pin 148 is disengaged from the end hole 126*b* with the tightening screw 162 loosened, allowing the driving arm 116 to be released from the drive shaft 124.

In this device, the driving plate 126 is disposed at the front portion of the inside of the machine frame, and protrudes further forward than the other parts provided inside the machine frame. Therefore, the driving plate 126 has to be extended outside an outer casing, (cover) 114 covering the front of the frame, through an opening on the cover. Alternately, it may be accommodated inside, if the cover is expanded. Also, coupling pin 148 has to be extended through an opening formed on the cover.

In the event that the cover has an opening, exposing the driving plate 126 through the opening is dangerous. Therefore, additional covering structure for the plate 126 is needed. Neither providing the additional covering nor expanding the cover is preferable from the design viewpoint.

SUMMARY OF THE INVENTION

In accordance with the present invention a knife driving device for cutting cloth in a sewing machine is provided. In one embodiment, the cloth cutting knife driving device in which an upper knife rocking arm interlocks with a sewing machine main shaft and can be released in an embodiment with fewer parts.

An object of the present invention involves providing a cloth cutting knife driving device having a structure that does negatively influence the aesthetics or manufacturability of a machine case.

A further object of the invention is to provide a cloth cutting knife driving device with excellent operability.

The present invention provides for a cloth cutting knife driving device. The device includes a drive shaft, which is able to swing rotatably, by interlocking with a main shaft. The device further includes a rocking arm rotatably supported on the drive shaft at the distal end for rocking motion, and a cloth cutting knife supported at the distal end of the rocking arm so as to be rigidly held in a cloth cutting position or an inactive position. The device may move up and down through the rocking motion of the rocking arm. The device has a coupled state and a released state for the drive shaft and the rocking arm, both states are brought about by an engaging part on the drive shaft and a movable member, movable with respect to the rocking arm in a direction perpendicular to an axial direction of the drive shaft. The coupled state is brought about by engaging the movable member with the engaging part, with the movement of the movable member in its axial direction toward one side. Whereas, the released state is achieved by releasing the movable member from the engage part with the movement of the movable member toward the other side. In a particular arrangement, the engaging part is a hole formed on the drive shaft, and the movable member is a pin with a tip at one end.

In one embodiment, the movable member and the engaging part are arranged inside the rocking arm, and the device further includes an operation member (15) for operating the movable member from outside the rocking arm. The present invention further includes a spring means mounted on the rocking arm for holding the movable member in the coupling state and the released state.

Advantageously, the device further includes positioning members for regulating the position where the movable member can engage with the engaging part when the coupling state is to be made. The device may include a spring member fixed on the machine frame for holding the operation member when the rocking arm is lifted up in the released state.

DETAILED DESCRIPTION OF THE DRAWINGS

Figure 1:
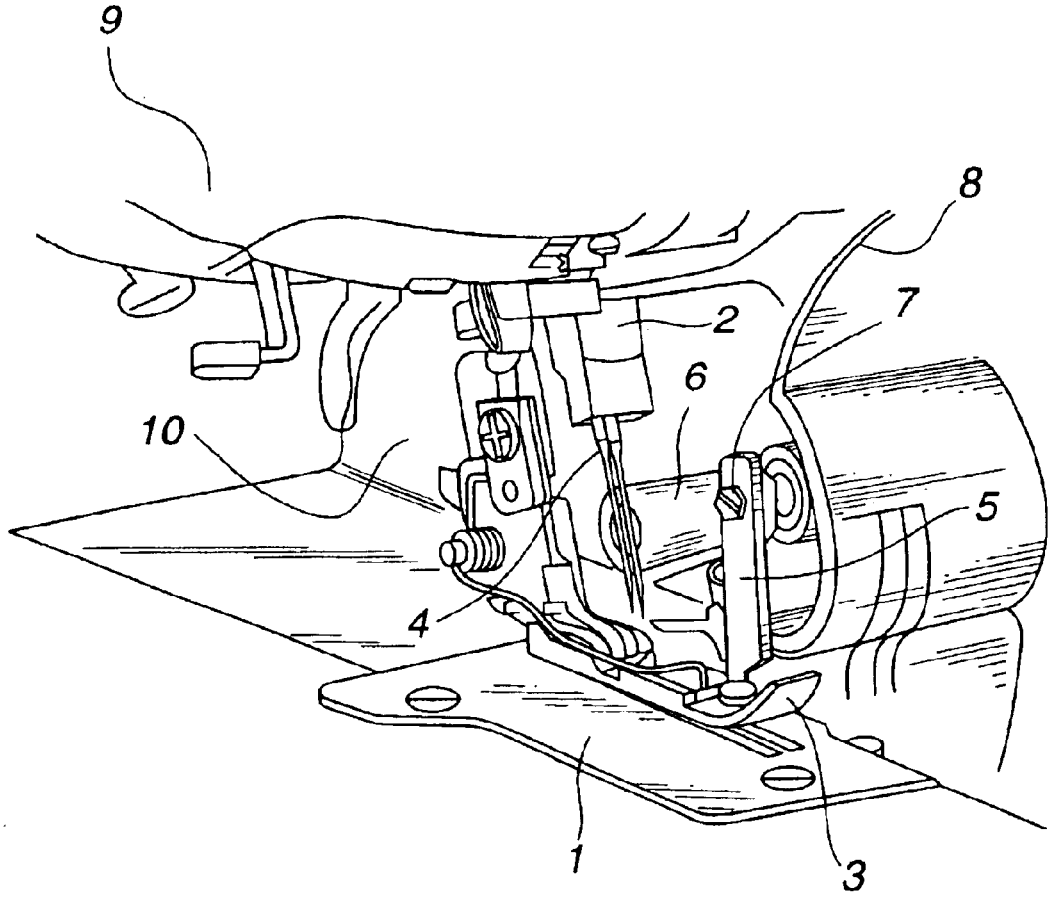
FIG. 1 is a perspective view showing a sewing machine with a looper cover closed incorporating a cloth cutting knife driving device according to one embodiment of the present invention.

An embodiment of the invention will be described with reference to the accompanying drawings. Referring to FIG. 1, a sewing machine incorporating a cloth cutting knife driving device according to the invention is capable of both over edge stitches and covering stitches, having a needle clamp 2 over a throat plate 1, a process foot 3 and needles 4.

The cloth cutting knife driving device includes an upper-knife rocking arm (rocking arm) 6, and an upper knife (cloth cutting knife) 5 secured on the rocking arm 6 with a set screw 7. A machine frame is covered with a front cover 9, a rear cover 10, and a looper cover 8 that covers the front of the rocking arm 6 in its closed state as shown in FIG. 1.

Figure 2:
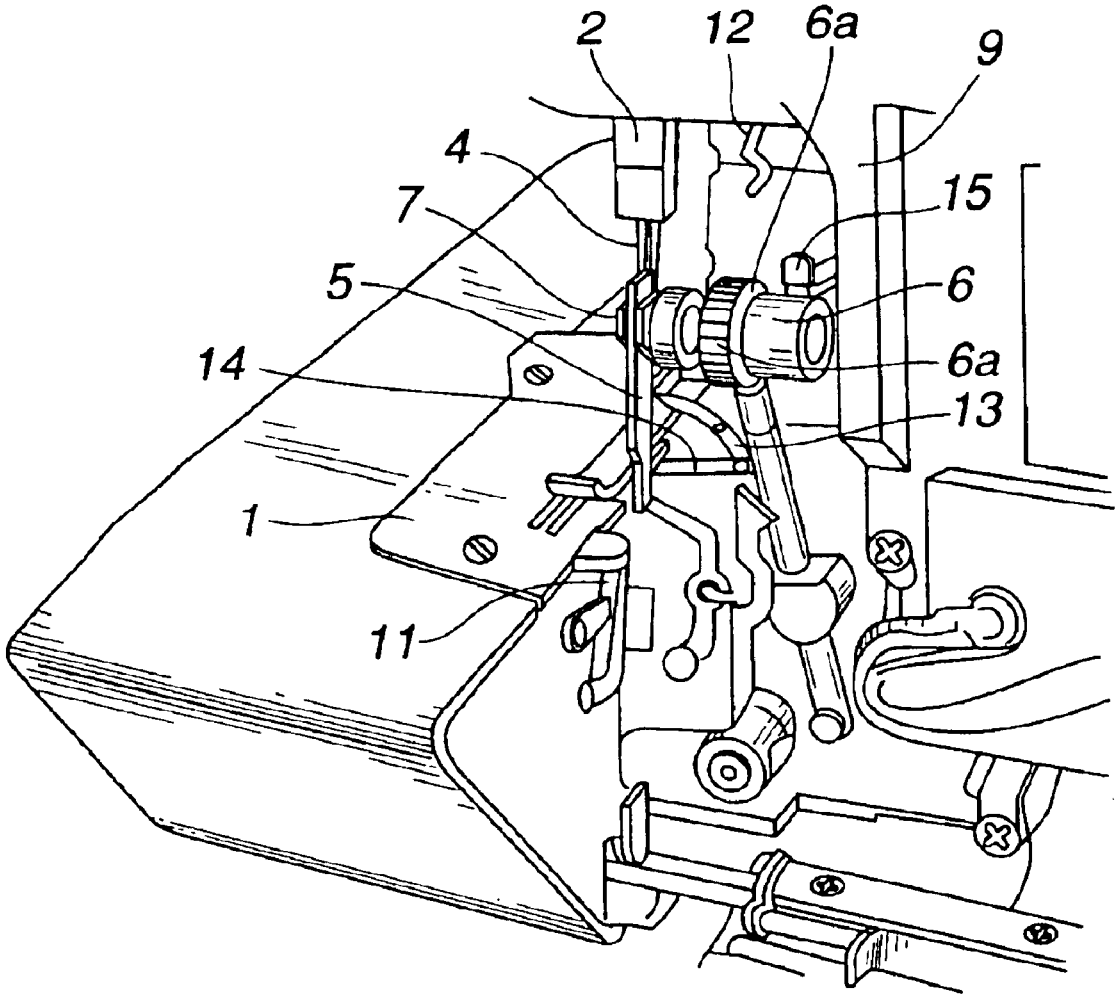
FIG. 2 is a perspective view showing the sewing machine with the looper cover opened incorporating a cloth cutting knife driving device according to one embodiment of the present invention.

FIG. 2 illustrates main elements of the device with the looper lever 8 opened. The upper knife 5 cooperates with a lower knife 11 to cut cloth. The upper knife 5 mounted on the rocking arm 6 is rotatable relative to the rocking arm 6 through a turning operation of an upper knife turning means 6*a*. A release lever (operation member) 15 is mounted on the rocking arm 6. A stopper spring (engage member) 12 is provided at a predetermined position on the front cover 9. An upper looper 13 and a lower looper 14 are incorporated as shown in the drawing for forming stitches.

Figure 3A:
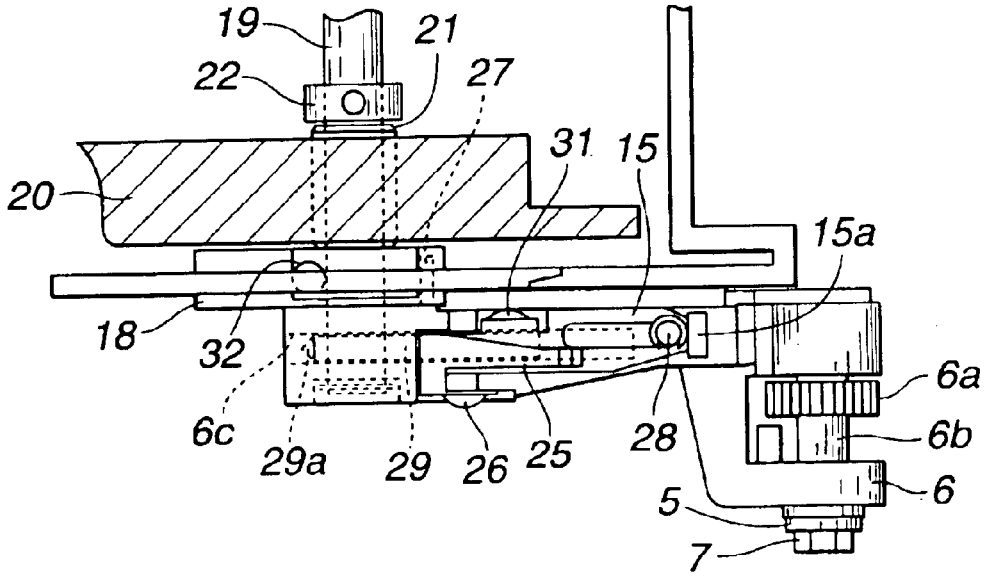
FIG. 3A is a cross-sectional plan view showing the cloth cutting knife driving device in a coupled state, wherein a knife drive shaft is coupled to a knife rocking arm.
Figure 3B:
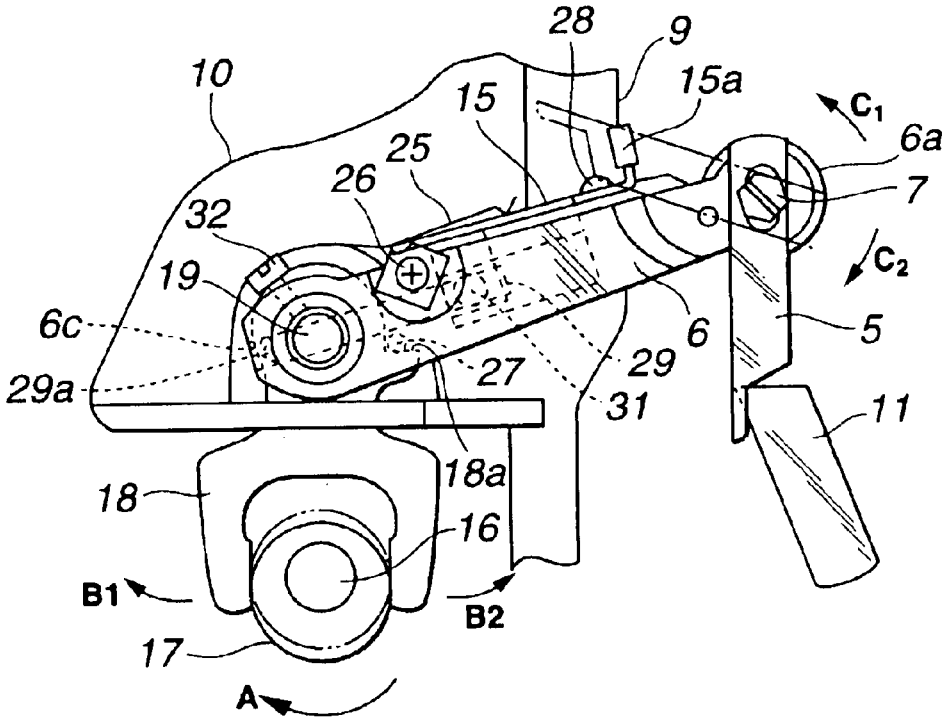
FIG. 3B is a side view, showing the cloth cutting knife drive device in a coupled state, wherein a knife drive shaft is coupled to a knife rocking arm.
Figure 4:
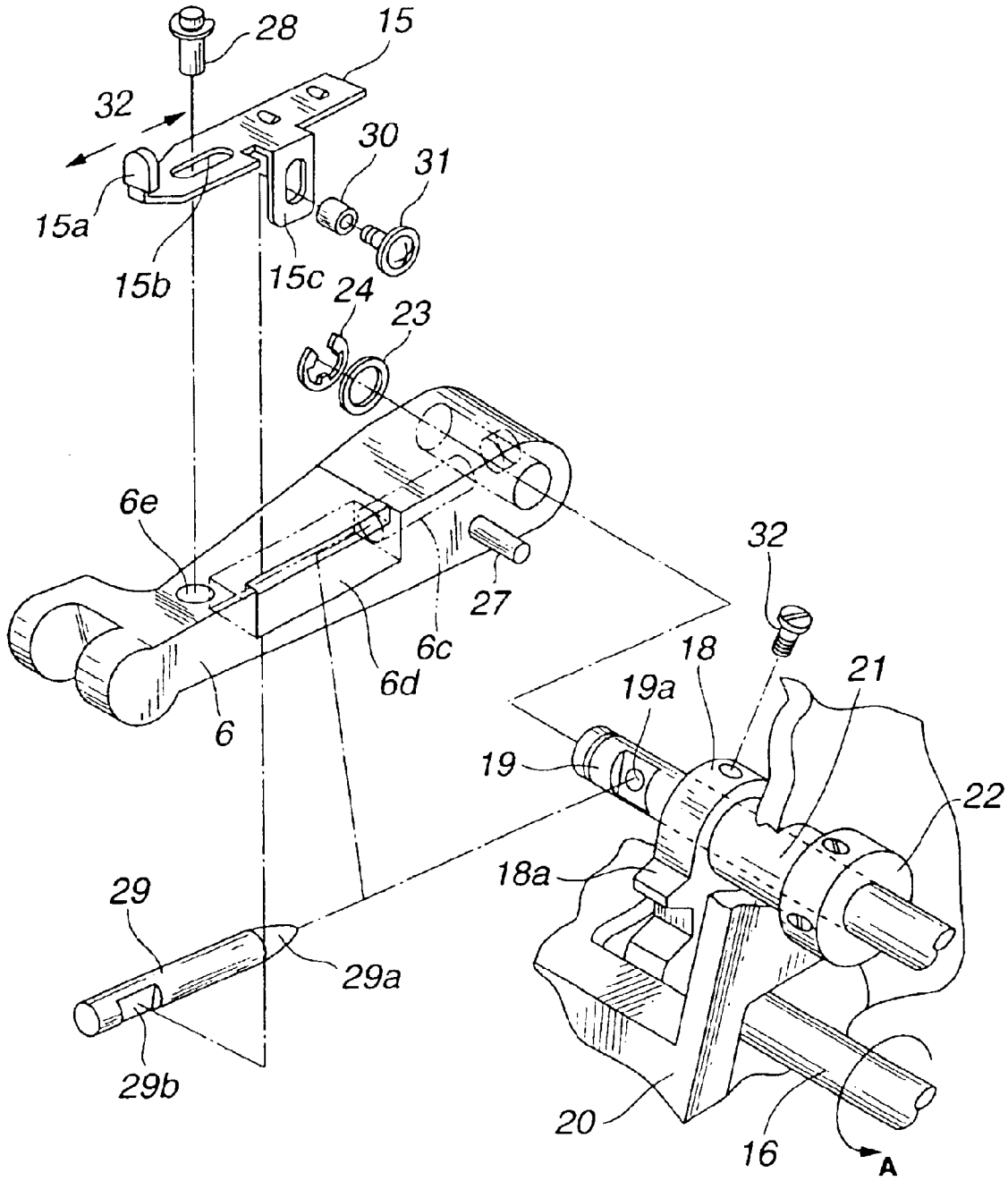
FIG. 4 is an exploded perspective view showing main elements of the cloth cutting knife drive device.
Figure 8:
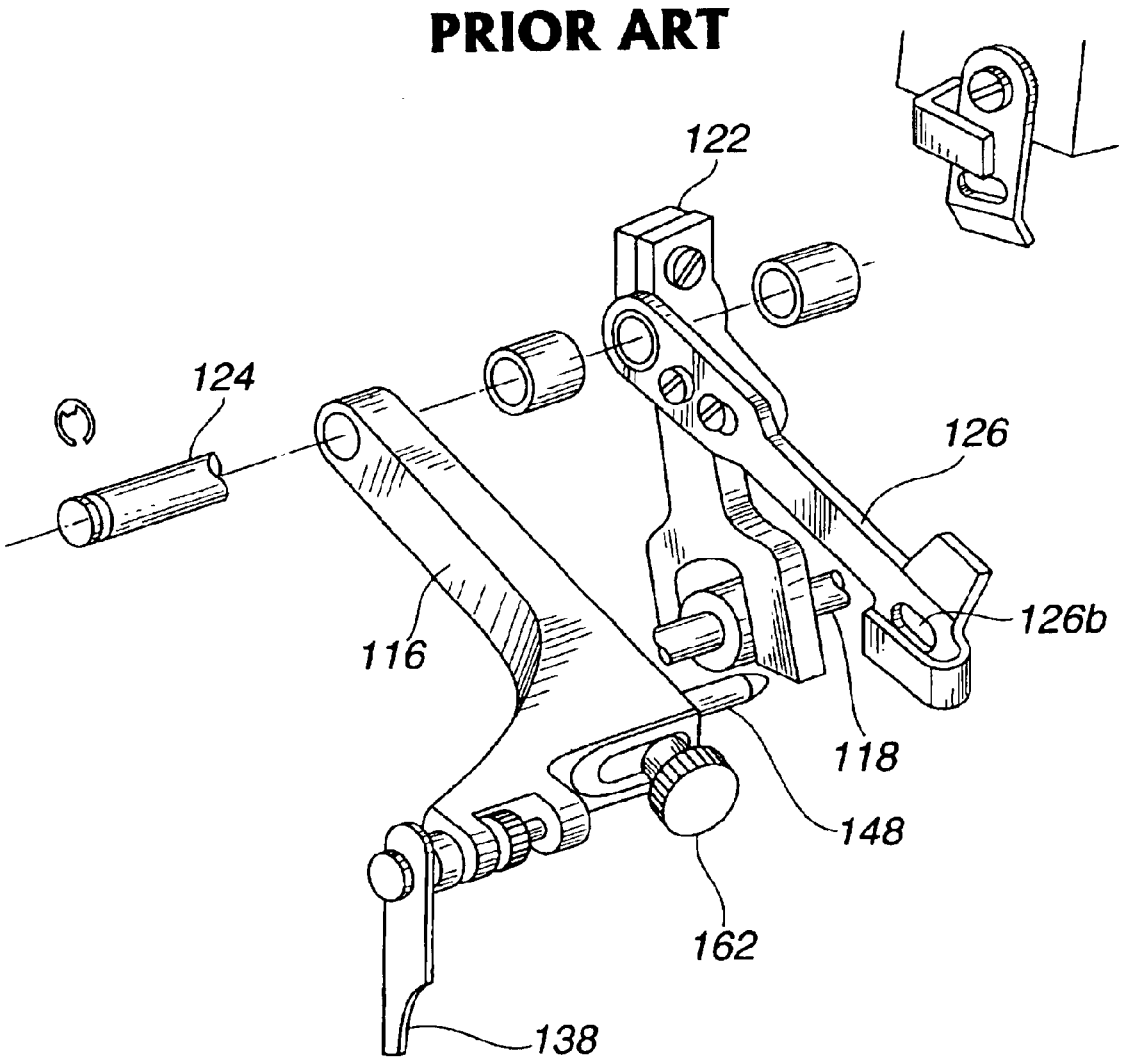
FIG.8 PRIOR ART
FIG. 8 is an exploded perspective view showing a conventional upper knife releasing device.

FIG. 3A shows the structure of main elements of the device in a cross-section plan view and 3B shows the structure of main elements of the device in a side view. FIG. 4 is an exploded view of the main elements of the device An upper-knife driving cam (transmitting member) 17 is rigidly mounted on a main shaft, 10 that is rotationally driven by a sewing motor (not shown). The cam 17 fits into a fork-shaped lower end of an upper-knife driving arm (transmitting member) 18. The cam 17 and the arm 18 constitute transmitting members for converting the rotating motion of the main shaft 10 into a rocking motion. An upper-knife drive shaft (driving shaft) 19 fits into a metal element 21, which is mounted on a machine frame 20, to be rotatably supported on the frame 20. At one end side of the metal element 21 on the knife drive shaft 19 (lower side in FIG. 8A), the upper end of the driving arm 18, one end (left end of FIG. 3A, FIG. 3B) of the rocking arm 6, a washer 28 and an E-type retaining ring 24 are assembled in this order. The rocking arm 6 is rotably supported on the drive shaft 19, whereas the driving arm 18 is secured onto the drive shaft 19 with a set screw 32.

A thrust collar 22 is screwed on the drive shaft 19 at the other end (upper side or FIG. 3A) of the metal element 21. At the upper surface of the rocking arm 6, the release lever 15 is mounted by way of a guide pin 28 and a press spring (sprung means) 25 so as to slide in a right-and-left direction in FIG. 3A, FIG. 3B. The spring 25 is fixed on the rocking arm 6 with a screw 26. At the other end (right end of FIG. 3A, FIG. 3B) of the rocking arm 6, a turning shaft 6*b* is rotatably mounted with the upper-knife turning means 6*a* fixed thereon. The upper knife 5 is secured on the turning shaft 6*b* with a set screw 7. The rocking arm 6 has a set pin (positioning means) 27 driven into and fixed on one side so that the pin 27 positions the rocking arm 6 in direction C2 in FIG. 3B by contacting a receiver (positioning means) 18*a* of the driving arm 18.

As shown in FIG. 4, the release lever 15 has a knob 15*a*, a slot 15*b* and an ear 15*c*. The rocking arm 6 has a pin-fitting groove 6*c* inside, wherein a release pin (movable member) 20 is inserted into the groove 6*c* so as to be slidable in a longitudinal direction. The release pin 29 has a tip 29*a* at one end, which is capable of fitting into an engaging hole (engaging part) 19*a* on the drive shaft 19. The ear 15*c* of the lever 15 is fixed onto a flat cut 29*b* of the pin 29 with a screw 31 and a collar 30. The rocking arm 6 has a recess 6*d* continuous with the groove 6*c*.

The assembling procedure for one embodiment of the present invention involves the following: inserting the pin 29 into the groove 6*c* from the recess 6*d*, attaching the collar 30 and the screw 31 to the lever 15, providing contact between the screw 31 and the flat cut, 29*b*, and inserting the guide pin 28 into a guide-pin hole 6*e* of the rocking arm 6 through the slot 15*b*. When the release lever 15 is assembled, it can be moved in a direction indicated by arrows 32 with the manipulation of the knob 15*a*, the release pin 29 also moves in the same direction, which allows for engaging with or disengaging from the hole 19*a*. The pin 29 and the hole 19*a* constitute coupling-releasing members for coupling or releasing the rocking arm 6 to or from the drive shaft 19, thereby entering a coupled or released state. The present invention does not require an opening on a machine cover as in the conventional sewing machine, because the coupling-releasing member is accommodated inside the rocking arm 6.

A description of operational state of the cloth cutting knife driving device for the present invention is provided below. Initially, let it be assumed that the release pin 29 engages with the drive shaft 19. The main shaft 16 rotates in the direction of arrow A indicated in FIG. 3B and FIG. 4 through energization of the sewing motor (not shown). The rotation of the main shaft 16 also rotates the driving cam 17, which causes the driving arm 18 to swing about the drive shaft 19 to pivot in the directions of arrows B1 and B2 as indicated in FIG. 3B. Because the driving arm 18 is secured on the drive shaft 19 with the set screw 32, the drive shaft 19 also swings. Since the release pin 29 engages the drive shaft 19, the rocking motion of the shaft 19 causes the rocking arm 6 to swing, the top end of the arm 6 swinging in the directions of arrows C1 and C2 as indicated in FIG. 3B. As a result, the upper knife 5, fixed to the top end of the rocking arm 6, moves up and down to cut the cloth.

Figure 5:
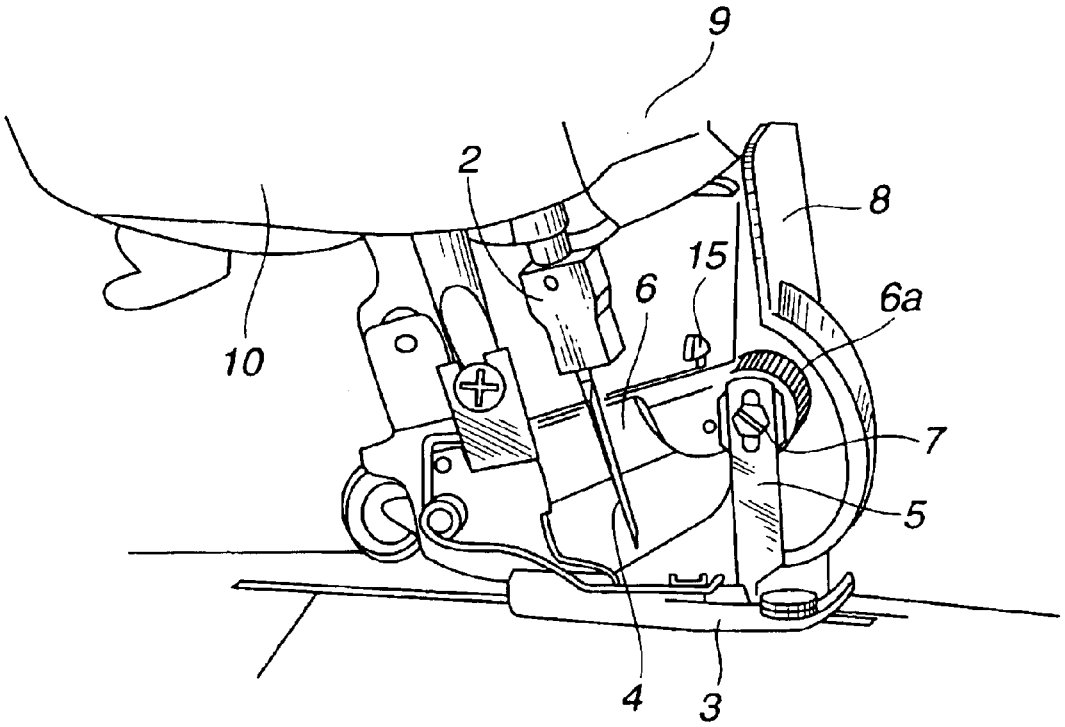
FIG. 5 illustrates the sewing machine with a looper cover closed incorporated with a cloth cutting knife drive device according to one embodiment of the present invention in the state of over-edge stitching.
Figure 6A:
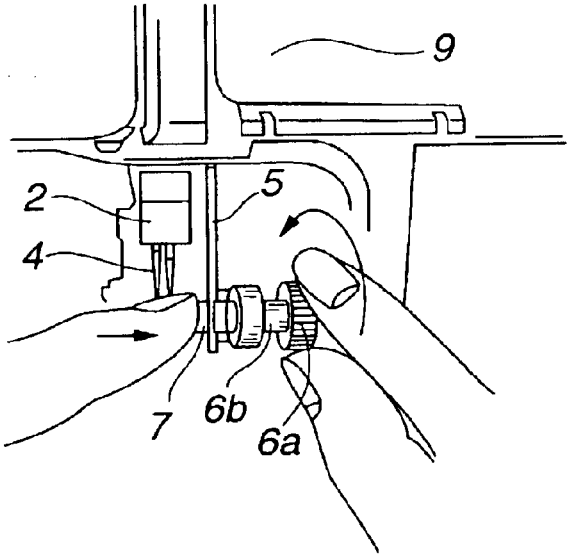
FIG. 6A illustrates the state of the device in which an upper knife is turned to an inactive position, also showing the manipulation of an upper knife turning means.
Figure 6B:
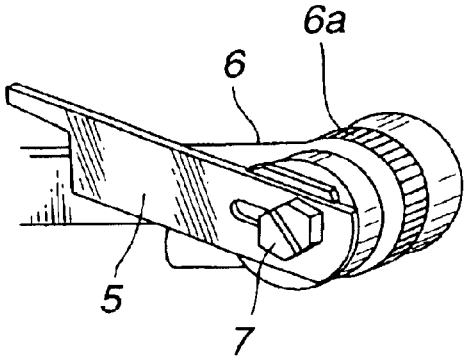
FIG. 6B illustrates the state of the device in which an upper knife is turned to an inactive position.

FIG. 5 shows a state of the machine that is capable of cutting the cloth with over edge stitches. The knife 5, supported on the rocking arm 6, cuts the cloth with its up-and-down reciprocating movement. When the cutting is not needed, the knife 5 is turned to the inactive position, wherein the upper knife does not engage with the lower knife. The inactive position is activated through the rotation of the turning means 6*a* as shown in FIGS. 6A, 6B. The release lever 15 is manipulated to stop the rocking motion of the rocking arm 6 in the present embodiment.

Figure 7A:
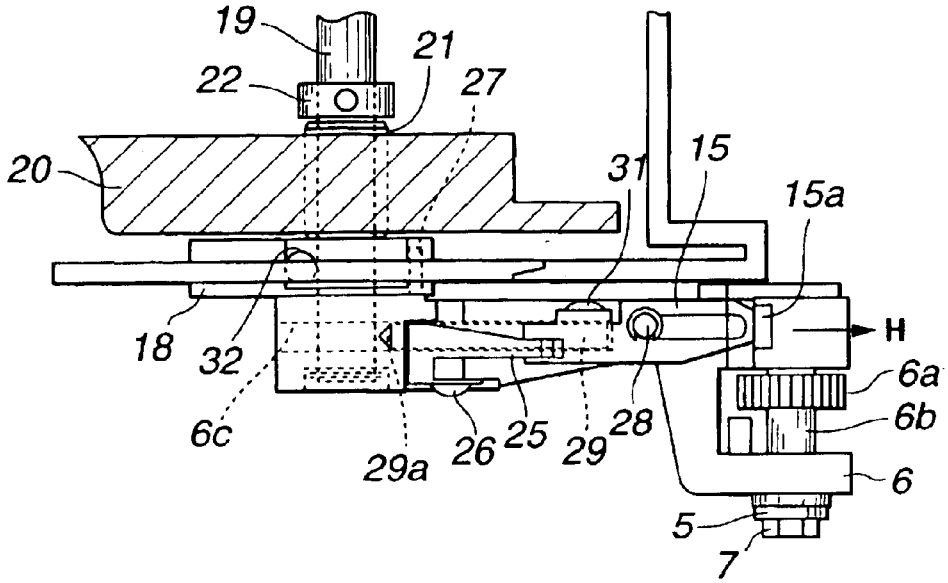
FIG. 7A is a cross-sectional plan view showing the released state of the device in which the knife drive shaft is released from the knife rocking arm.
Figure 7B:
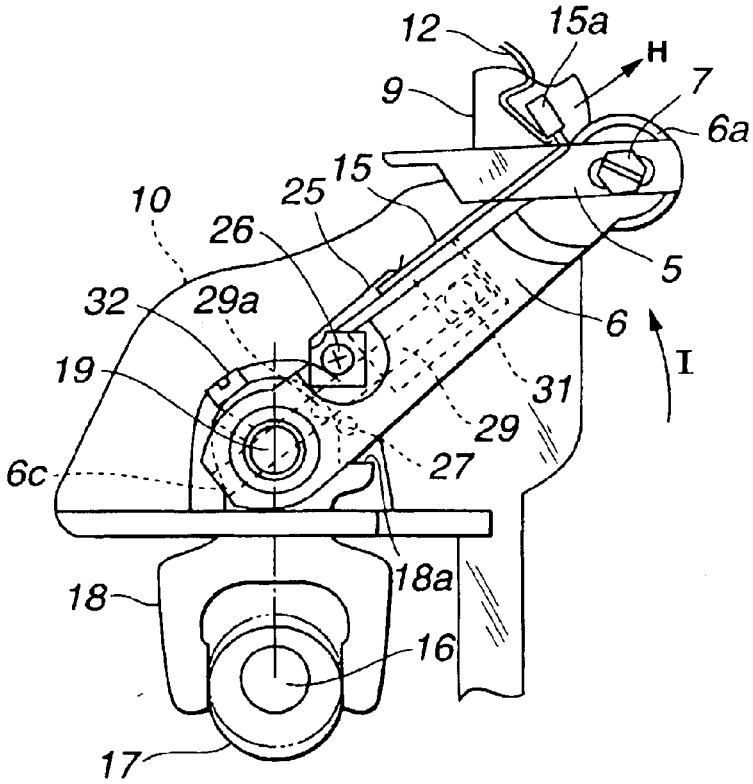
FIG. 7B is a side view showing the released state of the device, in which the knife drive shaft is released from the knife rocking arm.

Accordingly, in the operational state of covering stitches, the release lever 15 is pulled out in the direction of arrow H as shown in FIGS. 7A, 7B and disengages the release pin 29 from the drive shaft 19 in order to release the coupling between the driving arm 18 and the rocking arm 6. Therefore, the rotation of the main shaft 16 is not transmitted to the rocking arm 6. Moreover, as a result of disengagement of the rocking arm 6 from the drive shaft 19, the rocking arm 6 becomes manually rotatable, and can be moved upward in the direction I, with lever 15 pulled in the direction H. When rocking arm 6 is lifted up in the direction I of FIG. 7B, the knob 15*a* on lever 15 is engaged with a stopper spring (spring member) 12, provided on a certain position of the front cover 9. The stopper spring, in turn, holds lever 15.

When the upper knife 5 is to be actively driven, the process described above is followed in reverse order. When the rocking arm 6 is first pushed down, the set pin 27 on the arm 6 stops on the receiver 18*a* on the driving arm 18. The release lever 15 is then pushed in the direction opposite direction H, to allow rocking arm 6 to engage with the drive shaft 19. The upper knife 5 is turned to an active position (cloth cutting position) with the manipulation of the turning means 6*a*. The receiver 18*a* and the pin 27 act to bring rocking arm 6 into the position where the arm 6 is engaged with the drive shaft 19, coupling the release pin 29 to the hole 19*a* on the shaft 19.

In the embodiment described above, the release lever 15 is slidable along the rocking arm 6, and when it is moved toward the end on which the knife 5 is mounted, the rocking arm 6 is released from the drive shaft 19. Pushing the release lever 15 allows for coupling and pulling the lever 15 allows for releasing. The ease of these operations contributes to excellent user operability. Operations, such as, turning the knife 5 to the inactive position and manipulation of the lever 15, can be performed in the vicinity of the knife 5. Also, the stopper spring 12 on the cover 9 holds the lever 15 when it is in the released position. These additional aspects of the present invention further contribute to increase user operability.

In the event of sewing without the use of the knife 5, it is possible to remove the rocking arm 6 from the drive shaft 19 with the removal of the washer 23 and the retaining ring 24 from the drive shaft 19. This removal permits the knife 5 to be securely inactive, and allows for additional work space on the machine table.

Although the tip 29*a* of the release pin 29 engages with or disengages from the hole 19*a* of the drive shaft 19 in one embodiment of the present invention, any structure may be employed as long as it provides a coupling-releasing means between the drive shaft 19 and the rocking arm 6. For example, alternate combinations may include: a square block and a square hole, a release pin mounted on the drive shaft 19 and an engaging hole corresponding to the release pin on the rocking arm 6.

The rocking arm 6 is mounted and supported on the drive shaft 19 with the washer (fixing member) 23 and the retaining ring (fixing member) 24 in one embodiment of the present invention. However, other structures may be employed instead of the washer 23 and the retaining ring 24, to allow the rocking arm 6 to be removed from the drive shaft 19, in the event of sewing without the use of the upper knife 5.

According to one embodiment of the present invention, fewer parts are necessary to construct the device. Consequently, both the amount of undesirable movement associated with the upper knife and the cost of the device are reduced.

The device has as an engaging means, the pin, the corresponding engage hole, and the operation lever slidable along the knife-rocking arm. Simply sliding the lever back and forth puts the device in coupled or released states. Additionally, both switching the upper knife to active or inactive positions and the above-mentioned lever operation can be carried out in the vicinity of the knife. These aspects further accentuate the enhanced operability of the present invention.

Since the coupling-releasing member is not exposed outside of the case, an expanded portion of an outer case is not needed, thereby forming an advantageous design from an aesthetic and manufacturing standpoint. The operability is also improved through the engaging member on the frame holding the operation lever when it is in the released position. The coupling operation is eased, since the device has the positioning member, regulating the position where the coupling-releasing members are capable of coupling. The knife rocking arm is removably mounted on the knife drive shaft, therefore, the removal of the rocking arm with the knife advantageously contributes to a more secure and less congested work space.

The present invention is not limited to the embodiment described above, and numerous variations and modifications may be made within the scope of the present invention.

What is claimed is:

1. A cloth cutting knife driving device in a sewing machine, the device comprising:

a drive shaft, able to swing rotatably, by interlocking with a main shaft;

a rocking arm rotatably supported on the drive shaft at the distal end for rocking motion; and a cloth cutting knife supported at the distal end of the rocking arm, to be rigidly held in a cloth cutting position and an inactive position, and able to move up and down through the rocking motion of the rocking arm;

wherein the device has a coupled state and a released state between the drive shaft and the rocking arm, both states being brought about by an engaging part of the drive shaft and a movable member, that is movable with respect to the rocking arm in a direction perpendicular to an axial direction of the drive shaft; and wherein the coupled state is achieved by engaging the movable member with the engaging part, with the movement of the movable member in the axial direction toward one side, and the released state by releasing the movable member from the engaging part with the movement of the movable member toward the opposite side.

2. The device as claimed in claim 1, wherein the movable member and the engaging part are arranged inside the rocking arm, and the device further comprises an operation member for operating the movable member from outside of the rocking arm.

3. The device as claimed in claim 2, further comprising a spring means mounted on the rocking arm for holding the movable member in the coupled state and the released state.

4. The device as claimed in claim 2, further comprising positioning members for regulating the position where the movable member can engage with the engaging part when bringing about the coupled state.

5. The device as claimed in claim 2, further comprising a spring member fixed on the machine frame for holding the operation member when the rocking arm is lifted up in the released state.

6. The device as claimed in claim 1, further comprising positioning members for regulating the position where the movable member can engage with the engaging part when bringing about the coupled state.

7. A cloth cutting knife driving device in a sewing machine, the device comprising:

a drive shaft, able to swing rotatably, by interlocking with a main shaft;

a rocking arm rotatably supported on the drive shaft at the distal end for rocking motion; and a cloth cutting knife supported at the distal end of the rocking arm, to be rigidly held in a cloth cutting position and an inactive position, and able to move up and down through the rocking motion of the rocking arm;

wherein the device has a coupled state and a released state between the drive shaft and the rocking arm, both states being brought about by an engaging part in the drive shaft and a movable member, that is movable with respect to the rocking arm in a direction perpendicular to an axial direction of the drive shaft; and wherein the coupled state is achieved by engaging the movable member with the engaging part, with the movement of the movable member in the axial direction toward one side, and the released state by releasing the movable member from the engaging part with the movement of the movable member toward the opposite side, wherein the engaging part is a hole formed on the drive shaft and the movable member is a pin with a tip at one end.

8. The device as claimed in claim 7, wherein the movable member and the engaging part are arranged inside the rocking arm, and the device further comprises an operation member for operating the movable member from outside of the rocking arm.

9. The device as claimed in claim 8, further comprising a spring means mounted on the rocking arm for holding the movable member in the coupled state and the released state.

10. The device as claimed in claim 8, further comprising positioning members for regulating the position where the movable member can engage with the engaging part when bringing about the coupled state.

11. The device as claimed in claim 8, further comprising a spring member fixed on the machine frame for holding the operation member when the rocking arm is lifted up in the released state.

* * * * *